United States Patent [19]

Cadigan

[11] Patent Number: 5,065,840

[45] Date of Patent: Nov. 19, 1991

[54] SWIMMING POOL SAFETY LADDER

[76] Inventor: Lloyd Cadigan, 30 Witches Hollow Rd., Millstone, N.J. 08535

[21] Appl. No.: 609,445

[22] Filed: Nov. 5, 1990

[51] Int. Cl.[5] ..... E06C 9/00

[52] U.S. Cl. ..... 182/93; 182/46; 182/106

[58] Field of Search ..... 182/93, 46, 230, 106, 182/194

[56] References Cited

U.S. PATENT DOCUMENTS

| | | | |
|---|---|---|---|
| D. 157,436 | 2/1950 | Rogers | 182/106 X |
| 2,551,345 | 5/1951 | Scott | 182/106 X |
| 2,974,746 | 3/1961 | Baker | 182/93 |
| 3,311,195 | 3/1967 | Singer | 182/106 X |
| 3,420,558 | 1/1969 | Whitten, Jr. | 182/93 X |
| 4,023,647 | 5/1977 | Confer | 182/106 X |
| 4,418,792 | 12/1983 | Cerone | 182/106 X |
| 4,579,197 | 4/1986 | Spurling | 182/106 |

FOREIGN PATENT DOCUMENTS

| | | | |
|---|---|---|---|
| 2404929 | 8/1975 | Fed. Rep. of Germany | 182/194 |

*Primary Examiner*—Karen J. Chotkowski

*Attorney, Agent, or Firm*—Charles I. Brodsky

[57] ABSTRACT

A swimming pool safety ladder is described in which the individual steps employed are enclosed along both their side edges and along their back edge so as to prevent the accidental catching of one's hand, arm, foot, or leg between a step and the pool wall.

7 Claims, 2 Drawing Sheets

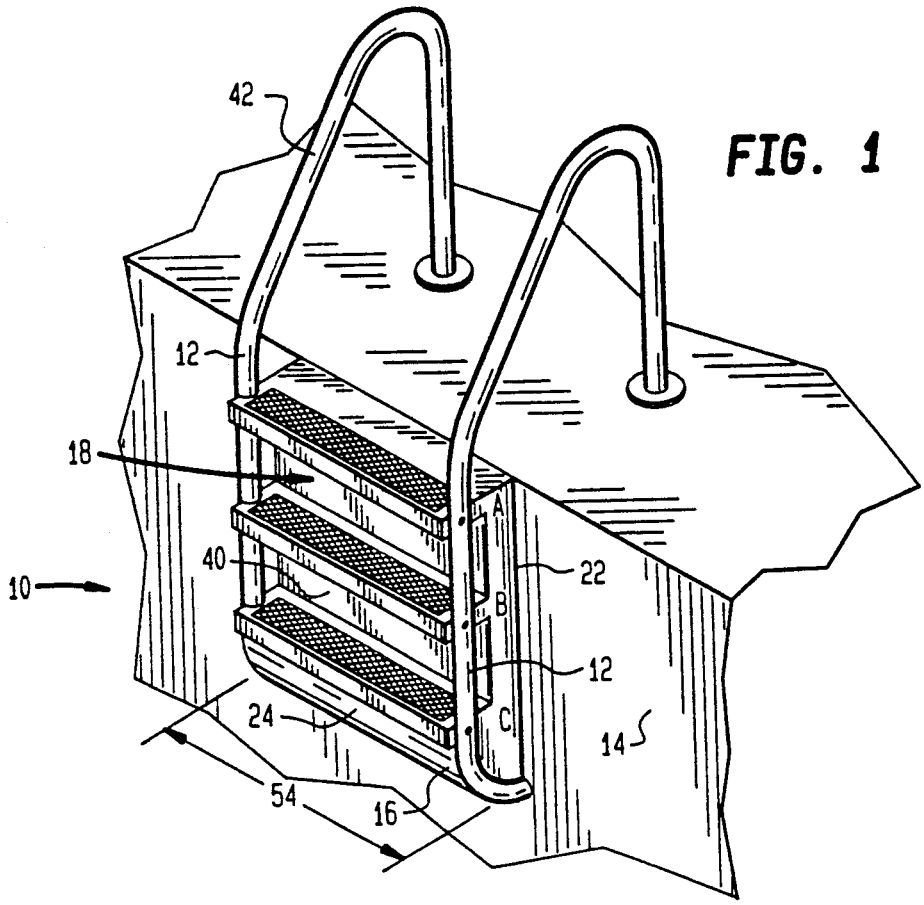
FIG. 1
FIG. 2
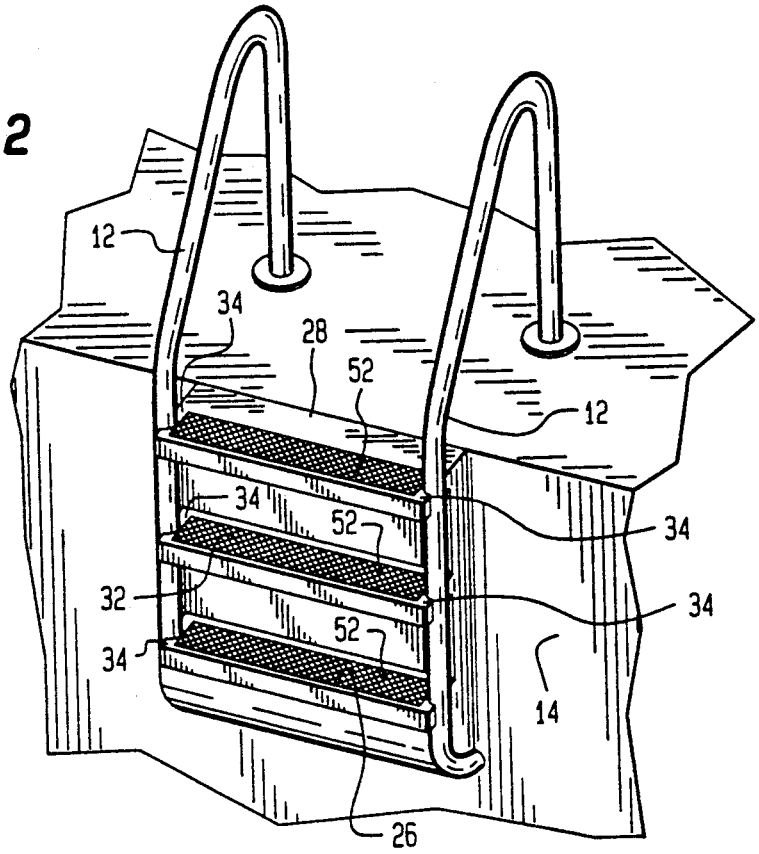

SWIMMING POOL SAFETY LADDER

FIELD OF THE INVENTION

This invention relates to swimming pool ladders and, more particularly, to a safety ladder which prevents the accidental catching of one's hand, arm foot, or leg between a step and the pool wall.

BACKGROUND OF THE INVENTION

As is well known and understood, the largest percentage of drownings in swimming pool accidents in any given year have been shown to be children generally between the ages of 5–12 years. In most of these cases, furthermore, the cause of the accident is not readily apparent. The question is often times asked, "what caused these children to drown, when they knew how to swim to begin with?". The answer is not easy in coming—at least, in part, because the victim cannot provide any answers to the question.

It is believed, however, that one of the areas for investigation in determining the cause of these accidents involves the swimming pool ladder maintained at the "deep end" of the pool. Observation of the ladder constructions typically employed reveal several clues: a) the hand-rails extend downwardly several feet below the surface of the water; b) there usually are two, and sometimes three, steps of the ladder which extend below the surface, as well; and c) the steps employed do not always extend so as to contact the pool wall.

In accordance with one postulation as to the cause of these swimming pool deaths—and, in accordance with the present invention—, it is quite possible, and has happened, that a child swimming underwater towards the ladder could get his, or her, hand or arm caught in the existing spacing between the bottom step and the pool wall, and as the child's head would already be below the surface of the water, where the child is already low on air, panic might then set in as to how to free himself, or herself, from being caught, with drowning being an unfortunate possibility. Not every child, under such circumstances, realizes the proper course of events, is to swim downwardly, towards the bottom of the pool, so as to free the hand, or arm, which is caught when the natural tendency is to try to break the surface of the water to gain the needed mouthfuls of air.

Even if this hypothesis were not correct, and only fanciful, the "spacing" which exists between the ladder steps and the side wall of the pool is such as to allow for a child's foot or leg to accidently catch in the opening when going down the ladder, and to cause serious injury if the child should then fall forward, into the pool, while his, or her, foot or leg is still held in such manner.

SUMMARY OF THE INVENTION

As will be seen from the following description, the swimming pool safety ladder of the present invention is one in which the individual steps employed are enclosed along both their side edges and along their back edge. In accordance with a prefered embodiment of the invention, the swimming pool safety ladder will be seen to be constructed of two components—first, a pair of hand-rails which, as is conventional, are of a dimension and configuration to extend from outwardly of the pool, down into the pool, and to be secured in place; and second, a unitized step-section, arranged to be connected to, and between, the two hand-rails, of a totally-enclosed construction, which bears against the pool wall, configured of a plurality of "steps", and with the bottom step being of contour to conform to any given contour existing with the bottom portion of the tubing comprising the hand-rails. As will be apparent from the description, the unitized construction eliminates any "spacing" for either hands, arms, feet or legs to be caught within, and to provide an overall, safe configuration. Furthermore, in accordance with the prefered embodiment, the unitized construction is dimensioned so as to accept the same types of securing devices presently employed with presently available swimming pool ladders, as in securing the steps employed nowadays to the hand-rail fabrication utilized. Thus, in accordance with the invention, all that becomes necessary is to unscrew, for example, the steps which presently connect to the ladder hand-rails, and to then screw into those hand-rails the unitized construction of the "step-arrangement" of the within design.

In accordance with a further embodiment of the invention, instead of utilizing a single, unitary construction, a plurality of "steps" can be individually secured, with each being at a depth to contact the pool side wall, but with the bottom step being continued to be contoured to conform to the curvature exhibited by the bottom of the hand-rail tubing. In such embodiment, an owner of a pool need only purchase replacement steps for those already present in the pool ladder construction, depending upon how many steps are needed, and in accordance with the required lengths for the steps, depending upon the hand-rail spacings. Any such purchase, however, would continue to require the curved-contour of the bottom step to ensure that no hand, arm, foot, or leg can unfortunately be caught.

BRIEF DESCRIPTION OF THE DRAWING

These and other features of the invention can be more clearly understood from a consideration of the following description, taken in connection with the accompanying drawing, in which:

FIG. 1 is a side perspective view of a swimming pool safety ladder embodying the principles of the present invention;

FIG. 2 is a top perspective view helpful in an understanding of the embodiment of FIG. 1;

DETAILED DESCRIPTION OF THE DRAWING

Figure 3:
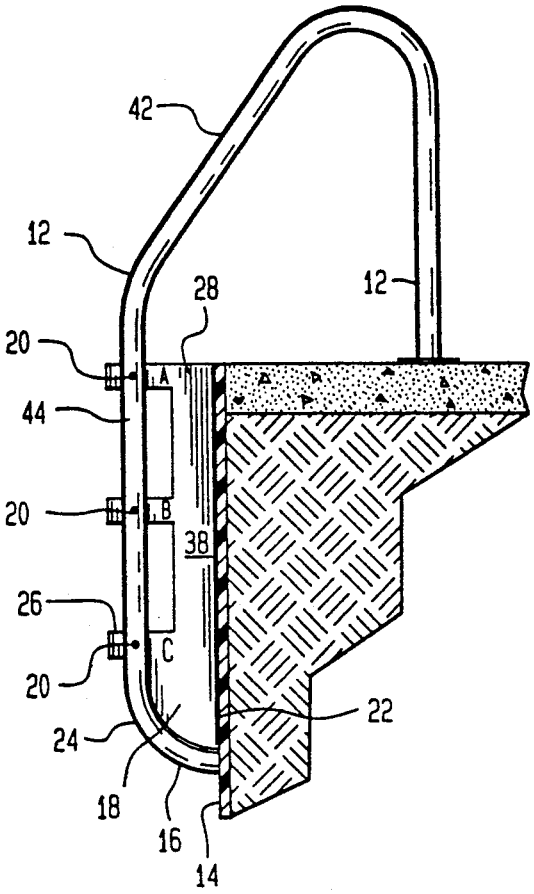
FIGS. 3–4 are side views helpful in an understanding of the invention.

Referring to the drawing, the swimming pool safety ladder 10 is shown as comprising a pair of hand-rails 12—typically of aluminum or stainless steel tubing construction—which extends upwardly and outwardly from the pool a distance usually of some 3 feet, or so. As will be appreciated, the ladder 10 is secured at the walkway external to the pool, in any appropriate manner, and to the inside walls of the pool, illustrated at 14. For purposes of safety, as well as cosmetics, the hand-rails 12 are configured, at their bottom ends 16 to curve inwardly to meet the pool wall 14, conventionally at a distance of 3–4 feet below the surface of the water in the pool.

In accordance with a preferred embodiment of the present invention, a unitized section 18 is fabricated, and to be secured to the hand-rails 12 by any type of fastener—such as by screws-or-bolts, extending through the hand-rails 12 and into the unitized section 18 at each of the "step locations" illustrated—as at A, B, C. In the arrangement shown in the drawing, it will be appreciated that the unitized section 18 has a rear wall 22 which extends to contact the pool wall 14, a curvilinear bottom section 24 which extends upwardly to form a bottom step 26, and a curvilinear top section 28 which extends horizontally to form the top step 30. As also will be seen from the drawing, a third step 32 is provided, between the bottom step 26 and the top step 30, in providing a 3-step ladder, and with each of the steps 26, 30, 32 being notched as at 34 to receive the hand-rail 12 in forming the overall ladder configuration.

As will first of all be noted, the alignment of the curvilinear top section 28 and top step 30 prevent anyone from getting a foot or leg caught behind a step—i.e. in spacing normally present between the rear of the step and the pool wall—so that foot, ankle and leg injuries are thus avoided. As will also be seen, the arrangement of the curvilinear bottom section 24 and bottom step 26 prevents the catching of one's hand or arm at the underside of the ladder, and the enclosed side edges 38 of the section 18 prevents the hand or arm being caught between any rear edge of a step and the pool wall—thus preventing the person from being caught anywheres underwater.

Figure 4:
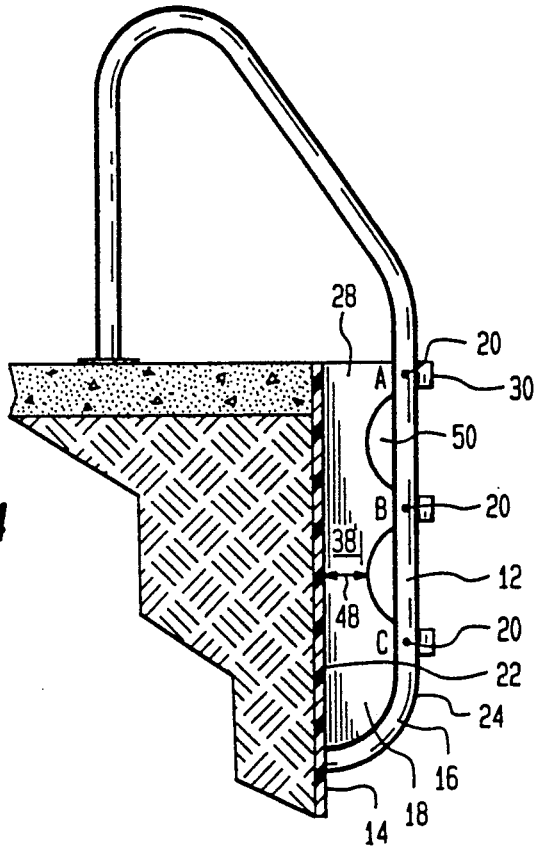

Although some spacing is shown to exist in the drawing between the hand-rails 12 and the front wall 40 of the unitized section 18(FIG. 3), it will be appreciated that this follows from the type of contour and fabrication of the hand-rails employed, such that if the hand-rails 12 were of a shorter length along the dimension 42, the vertical length of the hand-rail 44 would be positioned closer to the front wall 40 of the unitized section 18 than as shown. The spacing for the possible catching of one's hand or arm would thus be reduced—or altenatively, the thickness 48 of the unitized section 18 could be reduced, so as to widen the spacing, and thus make it easier to free one's hand or arm if caught, from the larger area that would result. One way of attending to this second possibility is having the underside area of the top step 30 join with the top of the middle step 32 in a concave manner 50 (FIG. 4) in a similar matter to that joining the underside of the middle step 32 to the top of the bottom step 26.

As with presently available designs, the steps 26, 30 and 32 —as well as the entire unitized section 18—may be constructed out of plastic, or of a plastic veneer. As also with present designs, the front portions 52 of the steps 26, 30, 32 can be roughed or scored, so as to provide better traction while being stood upon. And, as with present designs, the overall length 54 of the section 18 can be selected so as to match with hand-rails 12 already in place, so that the section 18 can be employed as a substitute for pool ladders already in use.

The embodiment of the invention so far described can easily be installed, merely by replacing the fasteners 20 which hold the presently utilized steps in place, and then substituting the section 18 to be similarly fastened together, at A, B, and C. All that is required is the use of a screw driver, and even with the length 54 of the unit 18 being selected of a standardized length to match the lengths of steps previously employed, should take no more than 5 minutes to place into position.

While there has been described what is considered to be a preferred embodiment of the invention, it will be appreciated that modifications can be made by those skilled in the art without departing from the scope of the teachings herein of using a swimming pool safety ladder in which the individual steps employed are enclosed along both their side edges and along their back edges. For at least such reason, therefore, resort should be had to the claims appended hereto for a true understanding of the scope of the invention.

I claim:

1. A safety ladder for a side wall of a swimming pool comprising:

a pair of handrails;

a plurality of vertically disposed steps secured to, and extending between, said handrails, each including a pair of opposing side edges and a back edge;

with said plurality of steps being fabricated of a construction joining together said back edges of adjacent steps of said plurality and also joining together corresponding side edges of adjacent steps of said plurality, thereby forming a unitized enclosure;

and with said construction joining together said back edges of said steps substantially flush with said swimming pool side wall; and wherein said handrails include a curvilinear section at one end thereof curving inwardly of said pool and towards said side wall, and wherein one step of said plurality incorporates an underside surface of corresponding curvilinearity, extending to contact said swimming pool side wall.

2. The safety ladder of claim 1 wherein each of said plurality of steps is notched along its side edges for receiving said handrails to which said steps are secured.

3. The safety ladder of claim 1 wherein said plurality of steps and the joins thereof are fabricated of a unitized plastic construction.

4. A safety ladder for a side wall of a swimming pool comprising:

a pair of handrails;

a plurality of vertically disposed steps secured to, and extending between, said handrails, each including a pair of opposing side edges, a front edge and a back edge;

with said plurality of steps being fabricated of a construction joining together said back edges of adjacent steps of said plurality and also joining together corresponding side edges of adjacent steps of said plurality, thereby forming a unitized enclosure;

with said construction joining together said back edges of said steps substantially flush with said swimming pool side wall; and with said construction joining together said steps to substantially vertically co-align each front edge thereof.

5. The safety ladder of claim 4 wherein said handrails include a curvilinear section at one end thereof curving inwardly of said pool and towards said side wall and wherein one step of said plurality incorporates an underside surface of corresponding curvilinearity, extending to contact said swimming pool side wall.

6. The safety ladder of claim 4 wherein each of said plurality of steps is notched along its side edges for receiving said handrails to which said steps are secured.

7. The safety ladder of claim 4 wherein said plurality of steps and the joins thereof are fabricated of a unitized plastic construction.

* * * * *